United States Patent [19]

Newell

[11] Patent Number: 4,621,557

[45] Date of Patent: Nov. 11, 1986

[54] ELECTRONIC MUSICAL INSTRUMENT

[75] Inventor: Harold R. Newell, South Newbury, N.H.

[73] Assignee: Mesur-Matic Electronics Corp., Salem, Mass.

[21] Appl. No.: 827,651

[22] Filed: Nov. 6, 1985

Related U.S. Application Data

[63] Continuation of Ser. No. 526,863, Aug. 26, 1983, abandoned.

[51] Int. Cl.[4] ..... G10H 1/12; G10H 1/46; G10H 5/10

[52] U.S. Cl. ..... 84/1.19; 84/1.16; 84/1.27; 84/DIG. 19

[58] Field of Search ..... 84/1.01, 1.11–1.13, 84/1.16, 1.19–1.27, DIG. 19, DIG. 30

[56] References Cited

U.S. PATENT DOCUMENTS

| | | | |
|---|---|---|---|
| 3,340,343 | 9/1967 | Woll | 84/1.13 |
| 3,749,809 | 7/1973 | Niinomi | 84/1.24 |
| 3,919,911 | 11/1975 | Nakata et al. | 84/1.27 |
| 4,300,432 | 11/1981 | Deutsch | 84/1.01 |
| 4,305,320 | 12/1981 | Peavey | 84/1.16 |
| 4,306,480 | 12/1981 | Eventoff et al. | 84/1.16 X |
| 4,336,734 | 6/1982 | Polson | 84/1.16 X |
| 4,430,918 | 2/1984 | Meno | 84/1.16 |

*Primary Examiner*—Stanley J. Witkowski

*Attorney, Agent, or Firm*—Pollock, Vande Sande & Priddy

[57] ABSTRACT

An electronic musical instrument which is capable of attaining the tonal coloration and "feeling" of an acoustic instrument and wherein the pitch, timbre, and loudness of each sound which is produced can be controlled by the performer in real time in an accurate and repeatable manner as the instrument is being played. The instrument is comprised of a plurality of string-like members which simulate the strings of an acoustic instrument and wherein sounds of varying pitch are produced by depressing the strings against a fingerboard at different positions along their lengths. An audio oscillator means is associated with each string-like member for producing a frequency-controllable audio output signal, and means responsive to a control signal for varying the overtone content and amplitude of the audio output signal is provided. In order to generate the control signal, means accessible to the performer and capable of being moved to different control positions in an accurate and repeatable manner is utilized. In the preferred embodiment, such means includes a light source and photoresponsive means, and a translatable means having an aperture for controlling the amount of light which is incident on the photoresponsive means.

2 Claims, 17 Drawing Figures

FIG.11
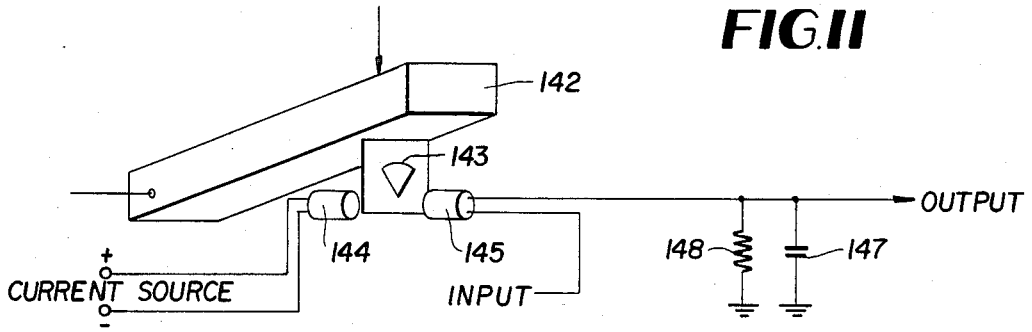
FIG.12
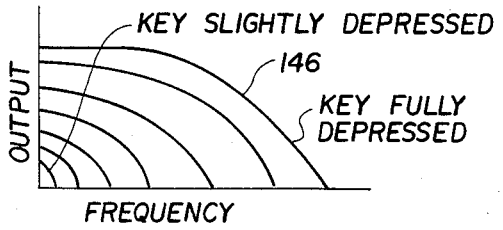
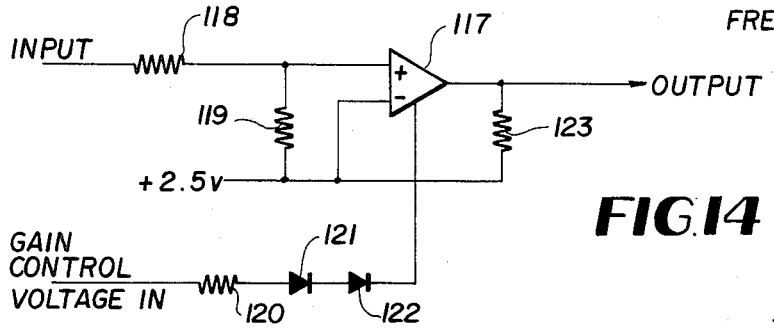
FIG.14
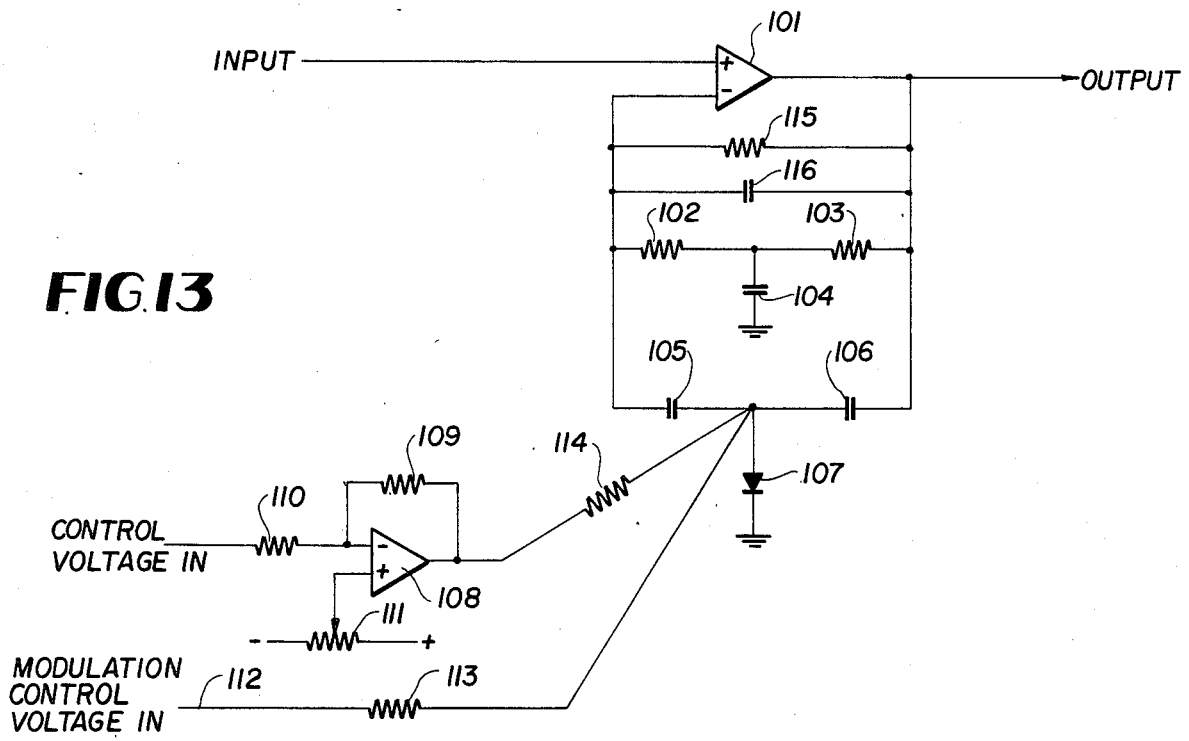
FIG.13

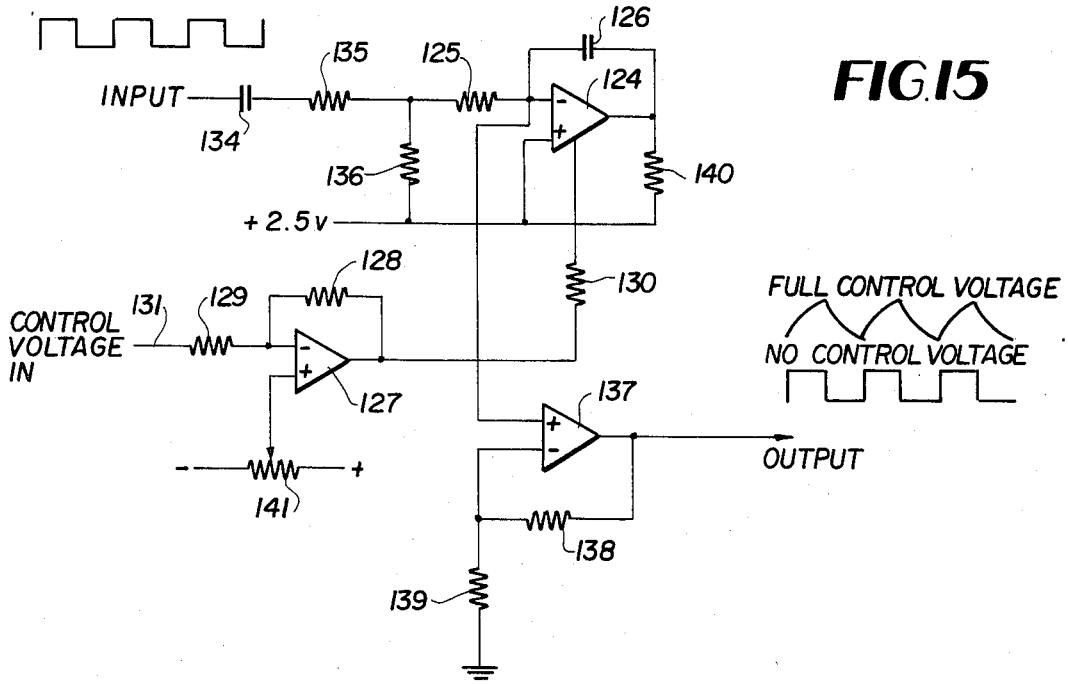
FIG.15
FIG.16
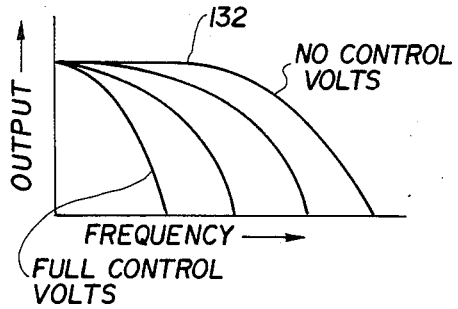
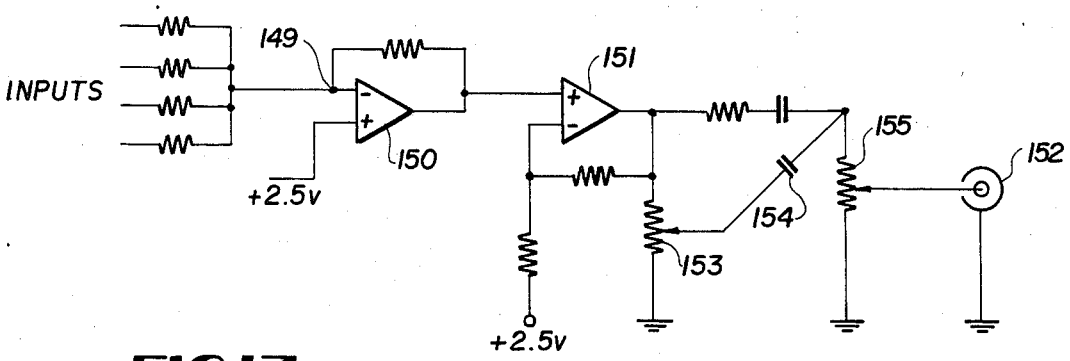
FIG.17

ELECTRONIC MUSICAL INSTRUMENT

This application is a continuation of application Ser. No. 526,863, filed Aug. 26, 1983 abandoned.

FIELD OF THE INVENTION

The invention relates to electronic musical instruments, and more particularly to an instrument which affords the performer a full range of real-time timbre and loudness control, to more nearly attain the sound and feeling of an acoustic instrument.

BACKGROUND AND BRIEF SUMMARY OF THE INVENTION

This invention relates generally to musical instruments and more particularly to those electronic instruments which are termed music synthesizers in which the sound waveforms are generated completely electronically with no mechanically vibrating elements contributing to the sound.

Music synthesizers are usually controlled primarily by means of a piano-type keyboard with sufficient keys to allow the production of at least one octave of the chromatic equally tempered scale. In the usual case, actuation of a key initiated the operation of a so-called "function generator" whose output voltage waveform, delineated by auxiliary control presets, causes the "attack" or fading in of the tone corresponding to the key pressed, and also the "decay" or fading out of the tone. The timbre or overtone content of the sound is similarly preset and not under the direct control of the actuating element.

The present invention, while an electronic music synthesizer, does not utilize a full keyboard for pitch control, but is a stringed instrument with a key associated with each string.

The purpose of the present invention is to make possible the accurate simulation of acoustic instruments, with their wide tonal coloration and ability to respond to the individual musician's "feeling".

To accomplish this, it is necessary that the qualities of pitch, timbre, and loudness be controlled in real time, that is not a preset quality as with a discrete tone fretboard or preset timbre and loudness control but under continuous control of the performer.

Toward this end, a fretless fingerboard is used in order that the widest possible range of pitch control can be realized. True vibrato and portamento can be accomplished as pitch change is continuous as with a violin.

Control of timbre and loudness is provided by a piano-like key for each string. The degree of actuation of this key directly controls the loudness and timbre or overtone content of the sound produced.

All synthesizers produce sounds by means of several basic waveforms, square waves, basis for reed instruments; ramps, basis for horns; triangular waveforms, basis for flute or piccolo sounds; or pulses, basis for violin, cello, etc. sounds. Filters, either fixed or pitch-following, shape these waveforms by subtractive synthesis to simulate those aforementioned instruments. These same type wave generating and shaping circuits are utilized in this invention although somewhat modified due to the novel pitch-controlling elements, i.e., the resistance strings.

The prior art does not disclose an electronic musical instrument which affords accurate, repeatable real-time control of timbre and loudness. Thus, U.S. Pat. No. 3,223,771 discloses an instrument utilizing a fingerboard where conductive strings are fingered into contact with an underlying continuous resistance element to provide continuous pitch change, but the instrument lacks the timberal control required for proper acoustic instrument simulation. Similarly, U.S. Pat. No. 4,235,141 discloses a fretless fingerboard which can control the instrument pitch in a continuous manner but here also continuous control of timbre is lacking.

U.S. Pat. No. 4,306,480 discloses an instrument intended for a toy which utilizes the fretboard-ladder resistor means of controlling pitch wherein a means is provided for controlling the pitch between fretted pitches by "bending" or swaying the strings as used by guitar players. Additionally, a "touch-responsive" control for providing glides of loudness and timbre is shown. However, this means shown is not intended for accurate or repeatable control of timbre and loudness as these qualities will depend upon the electrical resistance of the performers fingers, a value which varies widely with temperature, humidity, state of health, frame of mind, etc. Further, the contact resistance varies with slight finger pressure changes rendering accuracy impossible.

It is therefore an object of the present invention to provide an electronic musical instrument which is capable of attaining the tonal coloration and "feeling" of an accoustic instrument.

It is a further object of the invention to provide an electronic musical instrument wherein the pitch, timbre and loudness of each sound can be controlled by the performer in real time in an accurate and repeatable manner as the instrument is being played.

It is a further object of the invention to provide an electronic instrument having string members which simulate the strings of an accoustic string instrument and in which effects such as true vibrato and portamento can be attained by the performer.

In accordance with the invention, the above objects are accomplished by providing an electronic musical instrument having a plurality of string-like playing members which simulate the strings of an accoustic instrument and wherein sounds of varying pitch are produced at different positions along their length, which includes audio oscillator means associated with each string-like member for producing a frequency-controllable audio output signal, means responsive to a control signal for varying the overtone content and amplitude of the audio output signal, and means accessible to the performer and capable of being moved to different control positions for providing the control signal to control the timbre and loudness of each sound as its being produced. In the preferred embodiment, the means for providing the control signal includes a light source and photoresponsive means and movable means for controlling the amount of light which is incident on the photoresponsive means.

BRIEF DESCRIPTION OF THE DRAWINGS

The invention will be better understood by referring to the accompanying drawings in which:

FIG. 11 is a further embodiment of a key control and circuit.

FIG. 12 is a graphical illustration which depicts the operation of the key control and circuitry shown in FIG. 11.

FIG. 13 is a schematic diagram of the voltage controlled bandpass filters illustrated in FIG. 4.

FIG. 14 is a schematic diagram of the voltage controlled amplifier shown in FIG. 4.

FIG. 15 is a schematic diagram of the voltage controlled low pass filter shown in FIG. 4.

FIG. 16 is a graphical illustration of the low pass filter response.

FIG. 17 is a schematic diagram of the mixer and output amplifier.

DETAILED DESCRIPTION OF PREFERRED EMBODIMENT

Figure 1:
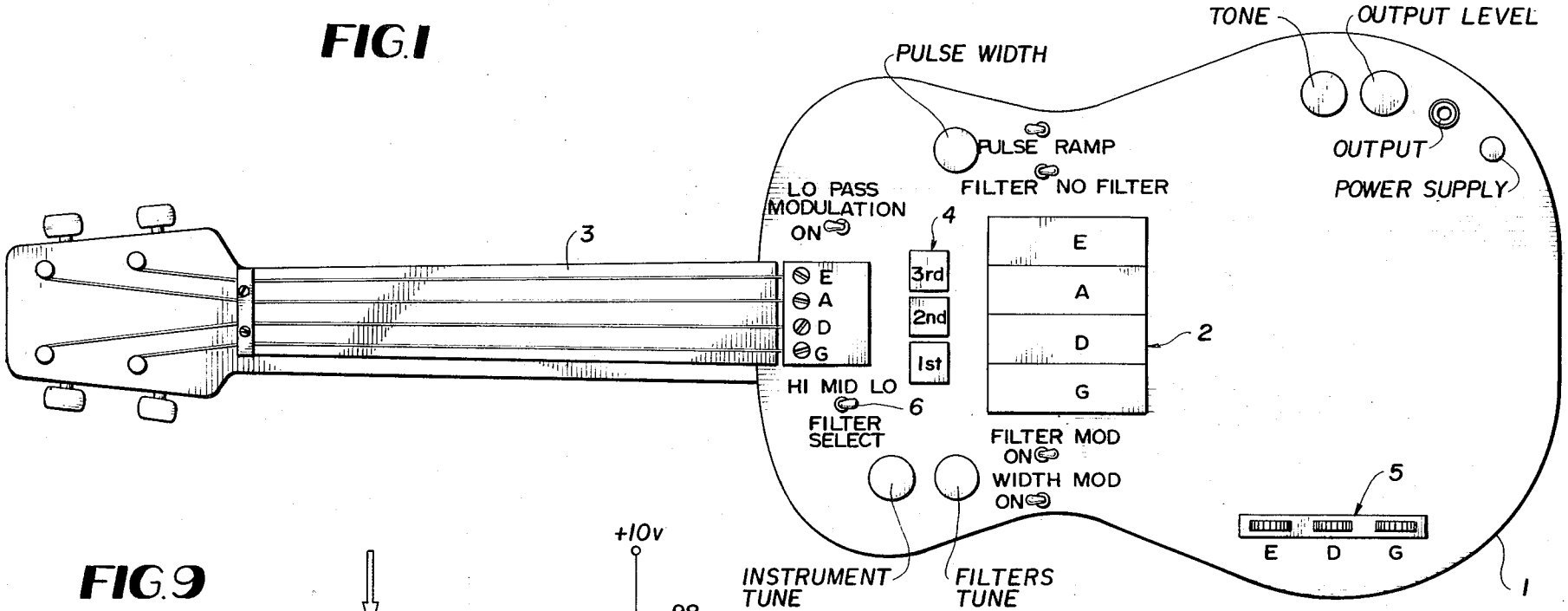
FIG. 1 is a pictorial illustration of the exterior of an electronic musical instrument in accordance with an embodiment of the invention.

Referring to the drawings, FIG. 1 is a pictorial illustration of a complete instrument according to the invention.

The body 1, which may be guitar-shaped, contains the electronic circuitry, sounding and timbre controlling keys 2, and the various controls. Additionally, it supports the neck 3 upon which the fingerboard and pitch controlling string resistors are mounted. The controls shown in FIG. 1 include octave push buttons 4, string tuners 5, filter selector 6, as well as other tuning and level controls to be described in detail below.

Although these various components are shown mounted on the instrument body, it should be understood that they could be separated without destroying the proper operation of the invention. For instance, the majority of the electronics could be placed in a remote package connected by a cable to the instrument. The sounding and timbre controlling keys could be similarly placed other than on the instrument body and cable connected.

Figure 3:
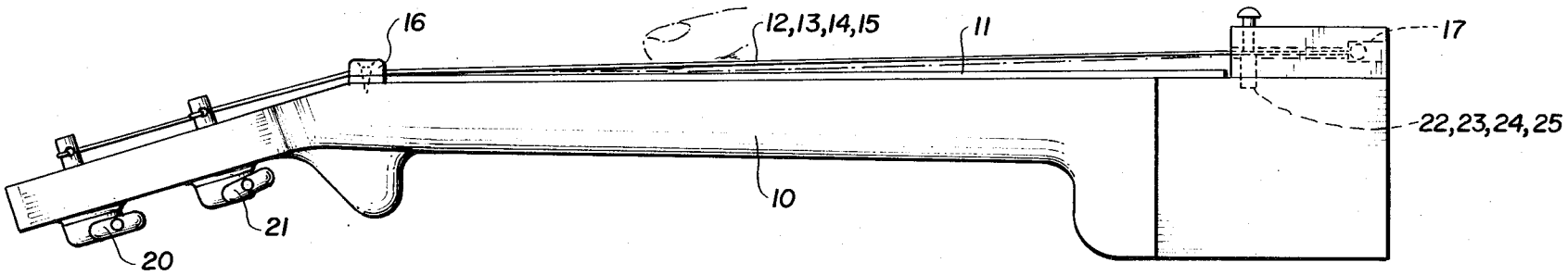
FIG. 3 is a side view of the neck portion of the instrument illustrated in FIG. 1.
Figure 2:
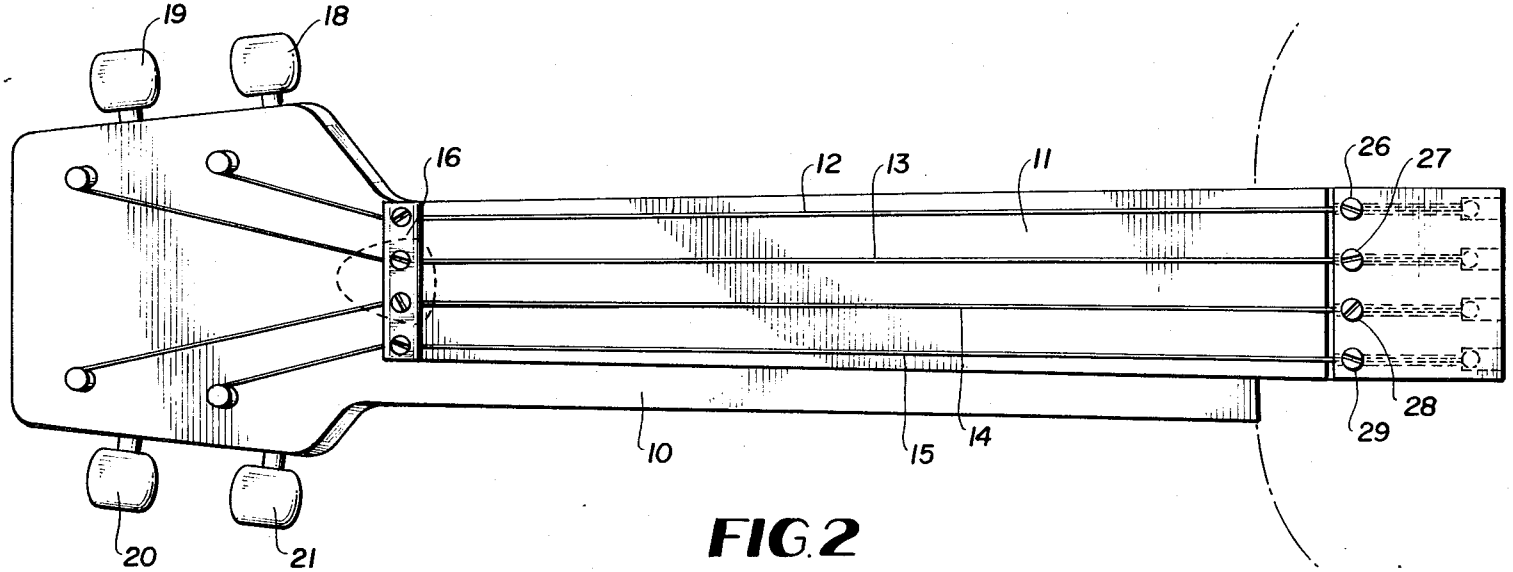
FIG. 2 is a top view of the neck portion of the instrument illustrated in FIG. 1.

FIGS. 2 and 3 show the neck assembly of the instrument, which supports the pitch controlling string resistor-fingerboard assembly. The instrument neck 10 supports the electrically conducting fingerboard 11 over which are stretched four string resistors 12, 13, 14 and 15 connected at nut 16 end to the conductive fingerboard 11. The other end of the strings 12, 13, 14 and 15 are fastened to the electrically insulating bridge 17.

Four machine heads 18, 19, 20, and 21 allow tensioning the string resistors slightly so they are properly placed above the fingerboard 11 while they may be easily depressed against the fingerboard for changing the pitch of the tone generator during instrument playing. At the bridge 17 end of the neck 10, electrical contact is made to the string resistors 12, 13, 14 and 15 by means of contacts 22, 23, 24 and 25 respectively to which wires are connected leading to the tone generators. Plastic or fiber screws 26, 27, 28 and 29 are used to press the strings 12, 13, 14 and 15 to make electrical connection to contacts 22, 23, 24 and 25. A further wire is connected to conductive fingerboard 11 and leads to electrical ground for all tone generators.

The string resistors 12, 13, 14 and 15 are resistive strings, the resistance of which increases linearly with length. As a string is pressed into electrical contact with the fingerboard closer and closer to the bridge, the electrical resistance is reduced, providing an indication of the contact position along the fingerboard and used to control the pitch of the tone oscillator to which the string is connected. In FIG. 3, the string in dotted line shows the string as pressed against the fingerboard by the performer's finger, thereby lowering the resistance of the string-fingerboard circuit.

The string tone generator circuits are normally tuned in 5ths, as on a violin or mandolin; highest "E" (660 Hz) next "A" (440 Hz), "D" (293 Hz), lowest "G" (195 Hz) for the highest octave, although other tunings are readily possible, such as 4ths as in a guitar bass.

The string resistors can be of varying construction, and for example may be comprised of a solid center core support, which can be a wire which is wound with electrical insulation, so as to be insulated from a spirally wound thin ribbon of stainless steel with adjacent turns spaced from one another which is wound around the insulated core, and which serves as the resistor. In an actual embodiment which was built, the Super Sensitive Stainless String Viola A Medium Tone made by Super Sensitive Musical String Company of Sarasota, Florida was used. It was found that such strings, while intended for use in a conventional string instrument, performed well as the resistance strings contemplated by the present invention. Typical string length from "nut" to "bridge" is about 11 inches, while the electrical resistance of this length is about 7 ohms.

The conductive fingerboard 11 may be made of any electrically conductive material, such as stainless steel or a plating such as nickel silver.

The fingerboard shown is fretless and smooth. However, raised conducting portions to form frets on the fingerboard could be used, providing discrete pitched tones such as with a guitar or mandolin.

The neck 10 in the preferred embodiment is similar in design to that used on the classic violin with position locating projections placed at either end. However, other designs may be used without departing from the spirit of the invention. The neck may be made of any material, wood having been used in the illustrated embodiment. Also, while 4 strings have been shown it should be understood that any convenient number could be used.

Figures 4, 5:
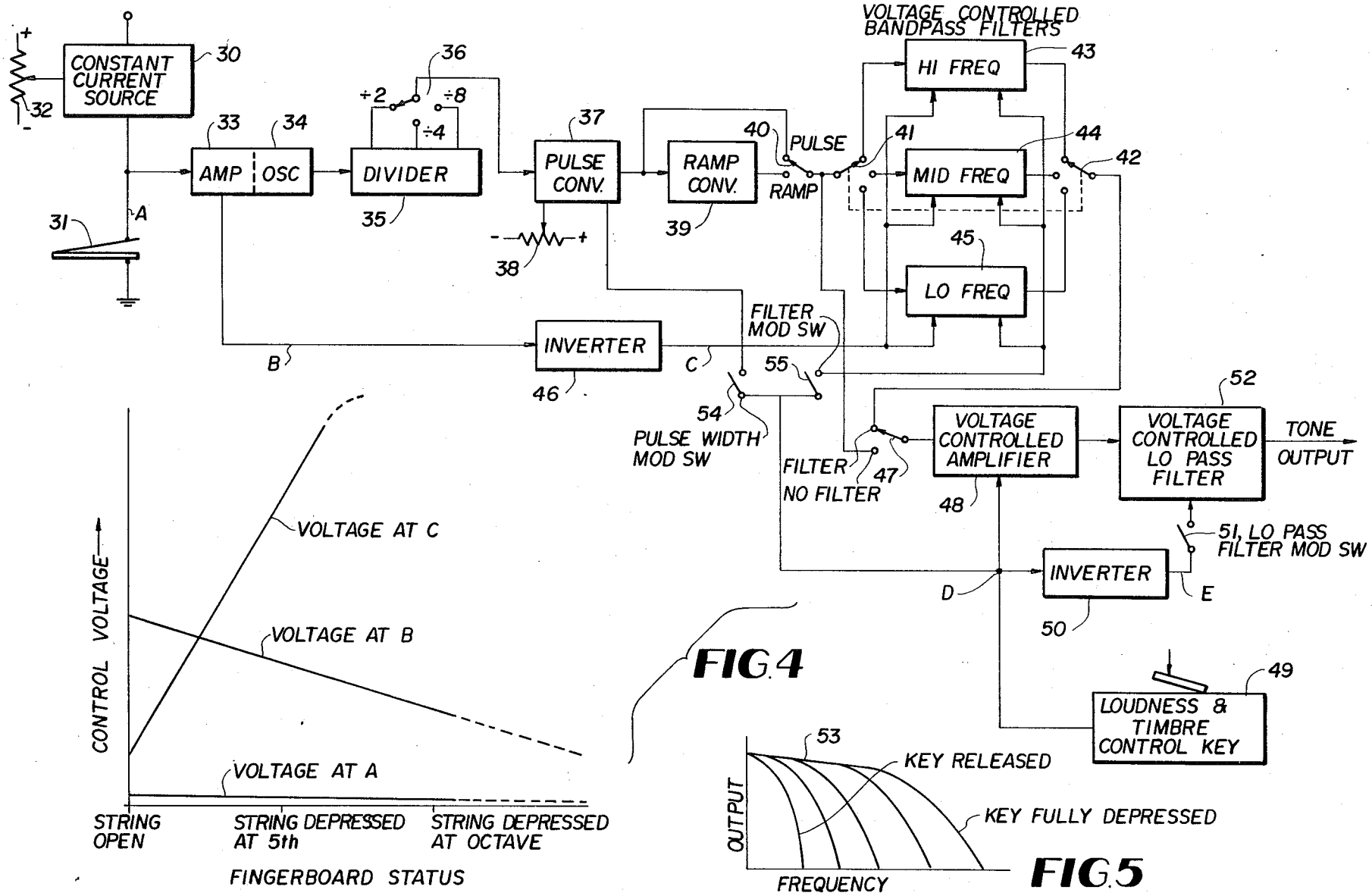
FIG. 4 is a block diagram of the electronic circuitry associated with a string of the instrument.
FIG. 5 is a graphical representation of curves illustrating how the cutoff frequency of the low pass filter changes with key position.

FIG. 4 is the functional block diagram of a typical tone generator, one being required for each string. Referring to the figure constant current source 30 supplies current to string resistor 31. A voltage appears across string resistor 31 which is inversely proportional to the resistance of the string resistor to its point of contact on the conductive fingerboard below it. Potentiometer 32 varies the constant current level and thus acts as overall tuning control for the tone generator.

The voltage across the string resistor is amplified by amplifier 33, which in the preferred embodiment has a gain of about 20×. This output voltage controls the frequency of oscillator 34, and the square wave output of oscillator 34 drives the frequency divider 35. Its divide by 2, 4 and 8 outputs feed switch 36 which is used for instrument octave selection.

The square wave output of switch 36 feeds the pulse converter circuit 37, which accepts square waves and converts the waveform to pulses which may be varied from square waves to about a 10:1 duty cycle pulse. A potentiometer 38 allows adjusting the pulse width.

The output of the pulse converter 37 is fed to ramp converter 39 which converts square waves to triangle waveforms. As a narrower and narrower pulse is fed to the ramp converter 39, a ramp with a sharper and sharper rise slope is produced, so that potentiometer 38 controls the ramp shape also.

Selector switch 40 allows selecting either the pulse or ramp waveform fed to the voltage controlled band pass filters while mechanically coupled switches 41 and 42 allow selection of the high center frequency 43, medium center frequency 44, or low center frequency 45 filter.

The voltage output of the string voltage amplifier 33 is inverted by inverter 46 so that it is directly proportional to the oscillator 34 frequency. This voltage is fed to the voltage controlled filters 43, 44 and 45 to cause their center frequencies to "track" the oscillator 34 frequency for simulating horn or woodwind sounds.

Selector switch 47 allows selection of the tone before or after it has been modified by the bandpass filters 43, 44 or 45 and passes it to the voltage controlled amplifier 48. The gain and thus output level of VCA 48 is controlled by the position of control key 49 whose output is dependent upon how far it is depressed.

When the key 49 is released there is no output from VCA 48, while when key 49 is fully depressed, VCA 48 output is maximum. The control voltage from the key 49 is inverted by inverter 50 and fed through switch 51 to the voltage controlled lo pass filter 52. As shown in the graph of FIG. 5, as the key 49 is depressed further, the cutoff frequency of the lo pass filter 52 rises allowing more overtones to pass through the filter. Thus, as the key 49 is depressed the timbre or tonal quality of the tone generator output is modified as the loudness is varied.

The output of voltage controlled lo pass filter 52 is fed, along with the output of the other tone generators to an output amplifier (not shown). Further timberal key control may be realized by feeding the key 49 voltage through switches 54 and 55 to control the pulse width-ramp shape and the band pass center frequency respectively.

The tone generator circuit provides the basic mechanism required for comprehensive control of pitch and timbre of any selected basic waveform in order to provide the musician with the widest possible control in simulating the complex sounds of accoustic instruments such as the various saxophones. This control is in real time and can be mofified moment-to-moment as pitch, loudness, and timberal parameters are directly controlled by finger positions.

Figure 6:
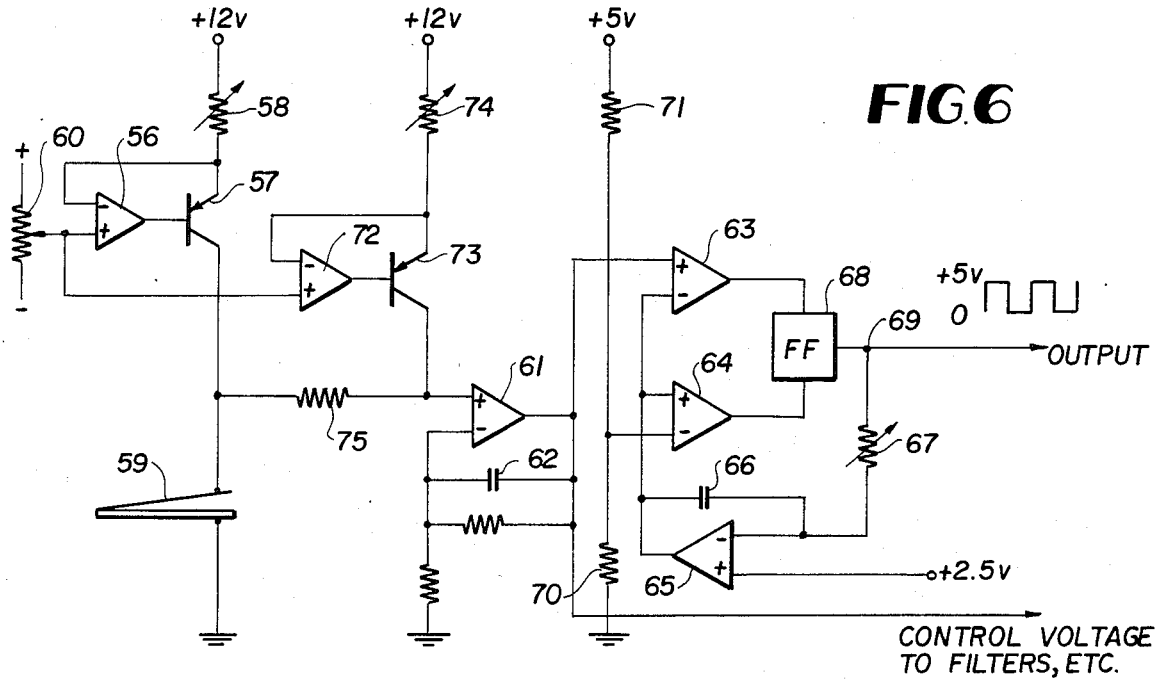
FIG. 6 is a schematic diagram of the oscillator block depicted in FIG. 4.

FIG. 6 shows the oscillator 33, 34 circuit of FIG. 4 in detail with certain other components of FIG. 4 being repeated in FIG. 6 for clarity. Amplifier 56 and transistor 57 and resistor 58 comprise a constant current supply circuit feeding the string resistor--fingerboard assembly 59. The potentiometer 60 serves to control the level of constant current, which allows presetting or tuning of the oscillator pitch, and is arranged to allow pre-setting of the pitches of all oscillators in parallel.

The voltage developed across the string resistor 59 is fed to an amplifier 61 with a voltage gain of about 20×. A capacitor 62 is placed in the feedback network of amplifier 61 to cause the output voltage changes to lag the input voltage changes for a more natural "clickless" sound when changing the pitch of the oscillator.

The output voltage from amplifier 61 serves as the upper limit of a dual comparator 63, 64 "window" circuit.

An integrator is formed by amplifier 65, capacitor 66 and variable resistor 67. When the output of amplifier 65 rises to exceed the upper limit defined by the output of amplifier 61, comparator 63 output triggers flip flop 68 output 69 "hi" which causes the output of amplifier 65 to integrate "lo" until it falls below the voltage at the reference junction of resistors 70 and 71, where the output of comparator 64 triggers the flip flop 68 output 69, "lo", causing the output of amplifier 65 to again integrate "hi". This action continues, producing a square wave at output 69.

Variable resistor 67 is used to trim each oscillator to its proper frequency, when each string has equal voltage across it. Once set, this control should not have to be re-set.

When the string resistor 59 is pressed down to the fingerboard at the octave point, for instance, the voltage across it falls to ½ the open string voltage. Thus, the output of amplifier 61 falls to ½, narrowing the comparator window so the output of integrator amplifier 65 having to rise only ½ as far can switch at 2× the rate, raising the output pitch 1 octave.

In practice, it is convenient to have the octave point at other than ½ the string length, for then the total string length can be reduced, saving space.

To allow this, a constant current source, formed by amplifier 72, transistor 73 and adjustable resistor 74, is used. This constant current source directly feeds the input of amplifier 61, and by dropping a voltage across resistor 59, pre-biases a amplifier 61, forcing its output higher than it normally would be from the voltage developed across string resistor 59 alone. Thus, string resistor 59 must be pressed to the fingerboard closer to the bridge than otherwise to reach the octave point.

Variable resistor 74 sets the position of the octave point. Input of constant current amplifier 72 is connected to the pitch setting potentiometer 60 to provide compensation so that the octave point won't shift when the pitch control 60 is reset.

The output of amplifier 61, which is inversely proportional to oscillator pitch or frequency is fed out to control the band pass filter center frequency.

Figure 7:
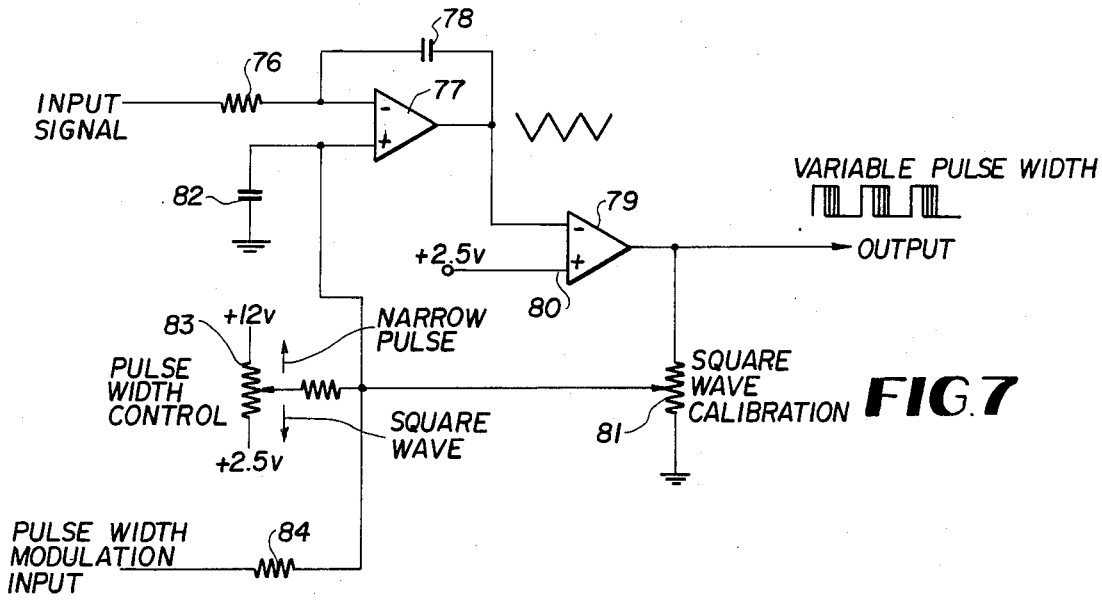
FIG. 7 is a schematic diagram of the pulse converter block depicted in FIG. 4.

FIG. 7 shows the pulse converter 37. This is used to convert the square waveform from the oscillator 34 and divider 35 through octave switch 36 to a variable width pulse.

In the operation of this circuit, the square waveform is fed to the integrator formed by resistor 76, amplifier 77 and capacitor 78. The output of amplifier 77 is a triangular symmetrical waveform. If no controlling feedback were provided, the output of amplifier 77 would soon drift into saturation. However, comparator 79 provides this feedback. As the output of amplifier 77 integrates up and down, it passes over the reference voltage at input 80 of comparator 79, and thus the output of comparator 79 switches "hi" and "lo" with a pulse or square waveform. This waveform is filtered or averaged by potentiometer 81 and capacitor 82, and serves as a reference for amplifier 77. Because of the negative sense of the feedback, the output of amplifier 77 is held within bounds.

With potentiometer 83 set to the +2.5 v. end, potentiometer 81 is normally adjusted to provide a square waveform at comparator 79 output, then left alone. Pulse width control potentiometer 83 allows adjusting the pulse width of comparator 79 output by feeding an offsetting current into the reference point of amplifier 77, forcing the average voltage of amplifier 79 to shift to compensate. Assuming a positive current fed to the reference point of amplifier 77, then the output of comparator 79 must stay "lo" longer than "hi" to compensate, thus producing a narrower width pulse. Thus, this self controlling integrator also does duty as a variable width pulse generator.

Another input to the reference point of amplifier 77 through resistor 84 provides means of modulating the pulse width. A voltage more positive than +2.5 v narrows the pulse width while voltages more negative than +2.5 v widen the pulse width.

Figure 8:
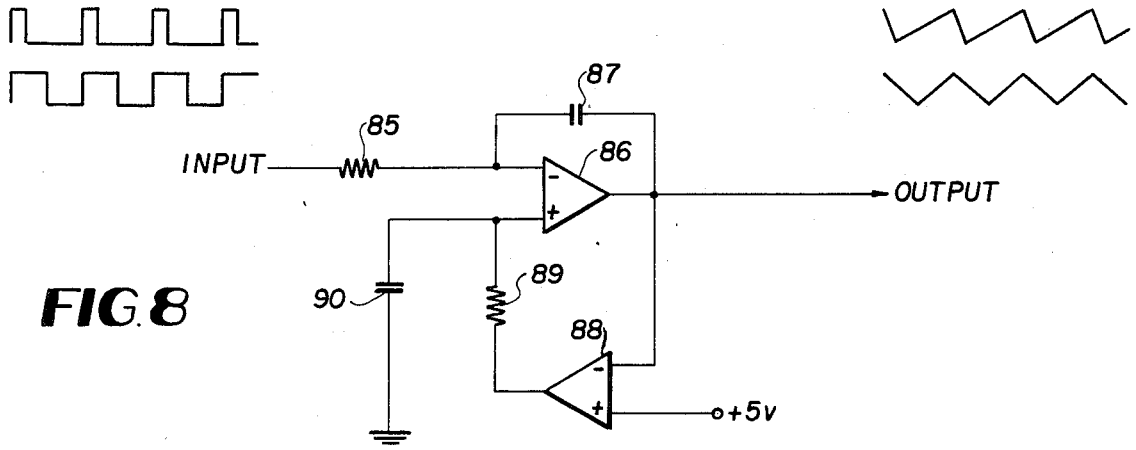
FIG. 8 is a schematic diagram of the ramp converter block depicted in FIG. 4.

FIG. 8 shows the ramp converter circuit 39. In this circuit, resistor 85, amplifier 86 and capacitor 87 form an integrator which accepts a square wave or pulse at its input and produces a triangle or ramp at its output. To prevent output drift, comparator 88, resistor 89 and capacitor 90 are provided. The filtered voltage from the comparator 88 output provides negative feedback to keep the integrator output at a fixed average DC level.

Figure 10:
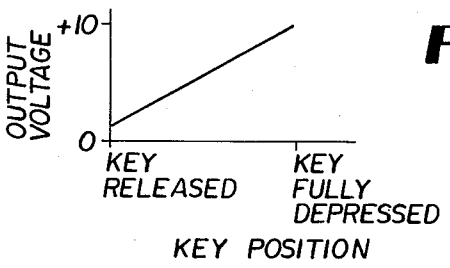
FIG. 10 is a graph depicting output voltage of the FIG. 9 circuit as a function of key position.
Figure 9:
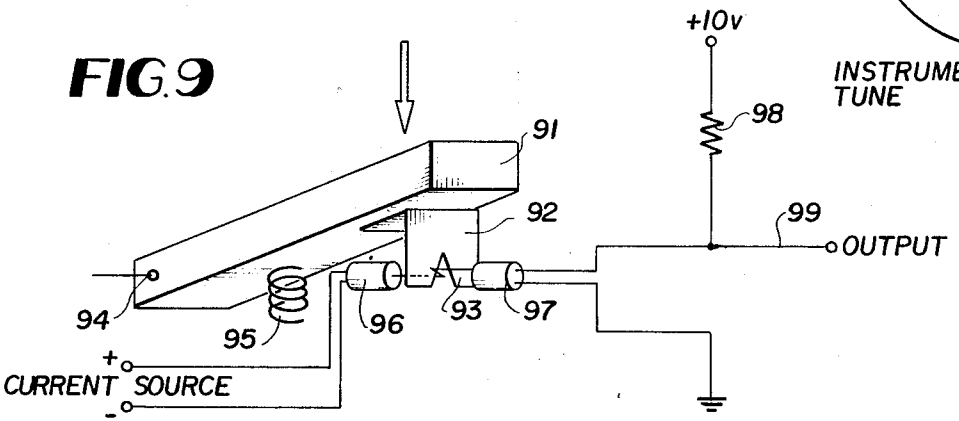
FIG. 9 is a pictorial illustration of a preferred embodiment of a key control and circuit.

FIG. 9 shows the key control arrangement 49. Here a piano-like key 91, used in the preferred embodiment, carries a light shutter 92, with a "V" shaped slot 93. The key 91 pivots at 94 and is returned to a released position by spring 95. An infra-red emitting LED 96 is at one side of the shutter 92 while a phototransistor 97 faces the LED 96 on the other side of the shutter. When the key 91 is in the released position, the aperture 93 is open and all infra-red emission from the LED falls on phototransistor 97, causing it to conduct all the current that can be supplied by resistor 98, so that output 99 is at about the +1 volt level. However, as the key 91 is depressed, the voltage at output 99 rises. FIG. 10 is a graph of voltage output vs. key position.

This key, which allows control of instrument parameters, is a vital link in providing precise timbre and loudness variations enabling the accurate simulation of complex acoustic instrument sounds such as that of the saxophone family.

FIG. 11 shows another embodiment of key control. This arrangement is simpler than the embodiment of FIG. 7 but may not be as effective. Here key 142 carries light shutter 143 which is placed between the incandescent light 144 and the photoresistor 145, which for example may be made of cadmium selenide.

The photoresistor is placed between the output of switch 47 of FIG. 3 and the mixer and output amplifier of FIG. 15 so the tone signal passes through it. This key controls loudness and timbre simultaneously as shown in the graph of FIG. 12. It does this due to the capacitor 147 and resistor 148 where the variable resistor 145 acts as a component in a resistive divider and a low pass filter section.

It is to be understood that while the key control embodiments of FIGS. 9 and 11 which use photosensitive means have been shown for purposes of illustration, the key control can be any arrangement using a means which can be moved by a person playing the instrument in a controllable and repeatable manner to change an electrical parameter.

FIG. 13 shows the circuit of the voltage controlled bandpass filters 43, 44 and 45, which uses an amplifier 101 having a Tee notch filter in its feedback loop.

Frequencies other than the notch frequency are fed back so that the gain of amplifier 101 is low. As the notch frequency is approached, feedback is reduced and gain is high at the notch frequency. Tee filter components have been chosen to widen the usually very narrow notch and provide a reasonable range of frequency control.

In this regard, resistors 102 and 103 are about 68,000 ohms in value, while capacitor 104 is 0.1 microfarads in the hi frequency, filter 43; 0.2 microfarads in the mid frequency, filter 44; and 0.4 microfarads in the low frequency, filter 45. Capacitors 105 and 106 are of equal value and vary according to the frequency of the string circuit in which they are used.

Diode 107 serves as a frequency control element whose impedance varies according to the current through it provided by the control voltage from the inverter formed by amplifier 108, resistor 109 and resistor 110. The input to inverter 108 is obtained from the string amplifier 33. This control voltage is inversely proportional to oscillator 34 frequency, and inverter 108 provides a directly proportional voltage to control the filter center frequency, so that center frequency follows oscillator frequency.

Potentiometer 111 allows pre-setting of the filter operating point while an additional input 112 allows for modulation of the filter center frequency by the voltage generated by the control key 91. Resistors 113 and 114 limit current flow to frequency control diode 107 while feedback resistor 115 and capacitor 116 tailor the amplifier 101 gain for optimum performance. Potentiometer 111 may be arranged to control pre-setting of all of the bandpass filter operating points.

FIG. 14 shows the circuit for the voltage controlled amplifier 48, and in this circuit a transconductance amplifier 117 such as the RCA CA3080A, is used as the control element. Resistors 118 and 119 serve as a voltage divider to attenuate the input signal. Control voltage from key 91 is applied through resistor 120 and diodes 121 and 122 to the gain control input of the transconductance amplifier 117.

Load resistor 123 is selected in value to provide the proper output signal voltage level with the current from amplifier 117. With the gain control voltage at +1 volt or below there is no current flow into the control input of amplifier 117 because of the diodes 121 and 122 drops and there is no signal out of amplifier 117. As the gain control voltage rises above about 1 volt, the signal output increases proportionally.

FIG. 15 shows the circuit for the voltage controller lowpass filter 52, in which a transconductance amplifier 124 such as RCA CA3080A is used as the control element. Resistor 125 and capacitor 126 serve as low pass filter with the apparent value of the capacitor 124 varied by means of the control voltage from the inverter formed by amplifier 127, resistors 128 and 129 fed through resistor 130 to the gain control input of amplifier 124.

As the control voltage 131 rises, the output of inverter 127 falls, lowering the gain of amplifier 124, reducing the apparent value of capacitor 126 and allowing higher frequency components to pass through the lowpass filter formed of resistor 125 and capacitor 126.

The graph of FIG. 16 shows the response of the circuit of FIG. 15 with varying input voltages.

Capacitor 134, resistors 135 and 136 comprise the input signal attenuation network, while amplifier 137 with gain control resistors 138 and 139 acts as a buffer to drive the main output amplifier (not shown). Resistor 140 serves as a gain limiting resistor load for capacitor amplifier 124 while trimmer potentiometer 141 sets initial control conditions for capacitor amplifier 124.

FIG. 17 shows the mixer and output amplifier used to accept the tones from the four generators of the preferred embodiment. In this circuit, the signals feed the summing junction 149 of inverter 150 while feedback amplifier 151 accepts this signal, amplifies it and passes it to the instruments output jack 152 where it is fed to an external power amplifier and speaker.

Potentiometer 153 and capacitor 154 are a control used to attenuate or accentuate the high frequency component of the signal for tone control, and potentiometer 155 is the output level or volume control.

It is to be understood that while specific embodiments of the invention have been described above, variations will occur to those in the art, and the scope of the invention is to be limited only by the claims appended hereto and equivalents.

I claim:

1. An electronic musical instrument having a plurality of elongated playing members, wherein sounds of varying pitch are produced by depressing the said playing members at different positions along their lengths, and wherein the timbre and loudness of the sounds produced by playing said instrument are continuously controllable by the performed during playing, to enable the sound and feeling of an acoustic musical instrument to be more nearly attained, comprising the following associated with each playing member, means for producing a square wave audio output signal, the frequency of which is dependent on the position at which the playing member is depressed by the performer, means for converting said square wave output signal to a pulse signal, said means for converting having a pulse width control input for receiving a signal for controlling the width of the pulses of said pulse signal, voltage controlled filter means having a controllable pass band and a pass band control input for receiving a signal for controlling said pass band, means for feeding said pulse signal to said filter means, voltage controlled amplifier means for amplifying said pulse signal after it is filtered by said filter means, said voltage controlled amplifier means providing an amplified tone output and having a gain control input for receiving a gain control signal, manually adjustable pivotable key control means capable of being reproducibly moved to a plurality of key control positions for generating a key control signal for varying both the amplitude and overtone content of said tone output, said key control signal or a signal derived therefrom being fed to said gain control input of said voltage controlled amplifier means, said pass band control input of said filter means, and said pulse width control input of said means for converting the square wave to a pulse signal, for simultaneously controlling the loudness and timbre of said tone output as the position of said key control means is changed.

2. An electronic musical instrument having a pluralty of elongated playing members, wherein sounds of varying pitch are produced by depressing the said playing members at different positions along their lengths, and wherein the timbre and loudness of the sounds produced by playing said instrument are continuously controllable by the performed during playing, to enable the sound and feeling of an acoustic musical instrument to be more nearly attained, comprising the following associated with each playing member, audio oscillator means for producing a square wave audio output signal, the frequency of which is dependent on the position at which the playing member is depressed by the performer, divider means for dividing said output signal by a plurality of different division factors which correspond to different octaves to provide divided square wave output signals, means for converting a selected one of said divided square wave output signals to a pulse signal, said means for converting having a pulse width control input for accepting a signal for controlling the width of the pulses of said pulse signal, means for converting said pulse signal to a ramp signal, a bandpass filter network comprised of a plurality of bandpass filters, each having a different center frequency, said filters being equal in number to the number of said different octaves, said bandpass filters having a controllable center frequency and having a center frequency control input for accepting a signal for controlling said center frequency, switch means for selectively connecting either said pulse signal or said ramp signal to said bandpass filter network, voltage controlled amplifier means for amplifying said pulse or ramp signal after said pulse or ramp signal is filtered by said bandpass filter network, said voltage controlled amplifier means providing an amplified output signal and having a gain control input for receiving a gain control signal, voltage controlled low pass filter means for filtering said amplified output signal for providing a tone output, said low pass filter means having a pass band control input for receiving a signal for controlling the pass band of said filter means, manually adjustable pivotable key control means capable of being reproducibly moved to a plurality of key control positions for generating a key control signal for varying both the amplitude and overtone content of said tone output, said key control signal or a signal derived therefrom being fed to said gain control input of said voltage controlled amplifier, said band control input of said voltage controlled low pass filter, said pulse width control input of said means for converting the square wave to a pulse signal, and said center frequency control inputs of said bandpass filters, for simultaneously controlling the loudness and timbre of said tone output as the position of said key control means is changed.

* * * * *